US006824430B2

(12) United States Patent
Matsumura et al.

(10) Patent No.: US 6,824,430 B2
(45) Date of Patent: Nov. 30, 2004

(54) FUSIBLE LINK UNIT

(75) Inventors: Norio Matsumura, Shizuoka (JP); Goro Nakamura, Shizuoka (JP); Keiichi Ito, Aichi (JP); Yoshihiko Nakahama, Aichi (JP); Kazuhiro Kusuyama, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/674,342

(22) Filed: Oct. 1, 2003

(65) Prior Publication Data

US 2004/0130430 A1 Jul. 8, 2004

(30) Foreign Application Priority Data

Oct. 2, 2002 (JP) ..... P2002-289614

(51) Int. Cl.[7] ..... H01R 13/68; H01R 33/95
(52) U.S. Cl. ..... 439/621; 439/622
(58) Field of Search ..... 439/621, 622, 439/721, 250, 65

(56) References Cited

U.S. PATENT DOCUMENTS

| | | | | |
|---|---|---|---|---|
| 2,934,627 A | | 4/1960 | Bristol et al. | |
| 4,842,534 A | | 6/1989 | Mobley et al. | |
| 5,088,940 A | | 2/1992 | Saito | |
| 5,438,310 A | | 8/1995 | Ikari | |
| 5,474,475 A | | 12/1995 | Yamaguchi | |
| 5,476,395 A | * | 12/1995 | Raffles et al. | 439/621 |
| 5,643,693 A | | 7/1997 | Hill et al. | |
| 5,795,193 A | | 8/1998 | Yang | |
| 5,977,859 A | | 11/1999 | Kawamura et al. | |
| 6,007,350 A | | 12/1999 | Isshiki | |
| 6,178,106 B1 | | 1/2001 | Umemoto et al. | |
| 6,294,978 B1 | | 9/2001 | Endo et al. | |
| 6,322,376 B1 | | 11/2001 | Jetton | |
| 6,402,569 B1 | * | 6/2002 | Spadoni et al. | 439/723 |
| 6,494,722 B1 | * | 12/2002 | Sakamoto et al. | 439/76.2 |
| 6,506,060 B2 | * | 1/2003 | Sumida et al. | 439/76.2 |
| 6,558,198 B2 | | 5/2003 | Kobayashi et al. | |
| 2002/0167390 A1 | | 11/2002 | Matsumura et al. | |

FOREIGN PATENT DOCUMENTS

| | | |
|---|---|---|
| JP | 10-199395 A | 7/1998 |
| JP | 2000/133114 | 5/2000 |

* cited by examiner

*Primary Examiner*—Chandrika Prasad
(74) *Attorney, Agent, or Firm*—Finnegan, Henderson, Farabow, Garrett & Dunner, LLP

(57) ABSTRACT

A fusible link unit having a fuse circuit structure containing a plurality of female terminal parts linked through fusible members to a linking plate and screw fixing terminal parts, which are connected to the fuse circuit structure in a chain manner, and a housing into which the fuse circuit structure is assembled, is disclosed. In the fusible link unit, the fuse circuit structure is formed by laminating a plurality of part plates, and the part plates include linking portions corresponding to the linking plates, and the female terminal parts with the fusible members connected thereto and the screw fixing terminal parts, which are shared by the part plates.

3 Claims, 16 Drawing Sheets

A-A

B-B

D-D

F-F

FUSIBLE LINK UNIT

The present application is based on Japanese Patent Application No. 2002-289614, the entire contents of which are incorporated herein by reference.

BACKGROUND OF THE INVENTION

1. Field of the Invention

The present invention relates to a chained type large current fusible link unit with fuse circuit structures each containing terminal parts with fusible members connected thereto, which are linked in a chain manner through the fusible members.

2. Related Art

JP-A-2000-133114 discloses conventional fusible link unit for example. One of fusible link units of this type as shown in FIGS. 14 through 16 is known. The fusible link unit designated by reference numeral 100, as shown in FIG. 14, is generally composed of first and second fuse circuit structures 101 and 102 and a housing 103 into which those fuse circuit structures 101 and 102 are assembled.

The first fuse circuit structure 101, as illustrated in FIG. 15, is made up of a linking plate 104, a plurality of terminal parts 106*a* and 106*b*, which are coupled through fusible members 105 to the linking plate 104, a battery terminal 107 extended from one end of the linking plate 104, and a common terminal part 108 coupled through a fusible member 105*a* to the other end of the linking plate 104. The first fuse circuit structure 101 is formed by pressing a conductive flat plate member (not shown).

The second fuse circuit structure 102, as shown in FIG. 16, is made up of a linking plate 109, a plurality of terminal parts 111*a* and 111*b*, which are coupled through fusible members 110 to the linking plate 109, and a common terminal part 112 extended from the other end of the linking plate 109. The first fuse circuit structure 101 is formed by pressing a conductive flat plate member (not shown).

As shown in FIG. 14, the housing 103 is shaped like a rectangular parallelepiped, and contains a circuit-structure accommodating chamber 114 with an opening 113 open to the upper. The housing further includes a plurality of connector housing portions 115 and a plurality of terminal supports 116, which are located under the circuit-structure accommodating chamber 114.

As shown in FIG. 14, the first and second fuse circuit structures 101 and 102 are each inserted into the circuit-structure accommodating chamber 114, through the opening 113 of the housing 103. In this case, an extending direction of the flat surface of each fuse circuit structure is an insertion direction, and the terminal parts (106*a*, 106*b*, 111*a*, 111*b*) of the fuse circuit structure are first inserted as an insertion tip part.

When the first and second fuse circuit structures 101 and 102 are completely inserted into the circuit-structure accommodating chamber, the linking plates 104 and 109 of those fuse circuit structures 101 and 102 are located within the circuit-structure accommodating chamber 114. The terminal parts 106*a*, 106*b*, 111*a*, and 111*b* are set at predetermined positions of the connector housing portions 115 and the terminal supports 116.

Next, the common terminal parts 108 and 112 of the first and second fuse circuit structures 101 and 102 are fastened together to the housing 103 by means of a bolt 117. The first and second fuse circuit structures 101 and 102 are electrically connected to each other to thereby form a desired fuse circuit.

The battery terminal 107 is also fastened to the housing 103 by means of a bolt 117*b*. A terminal of a battery cable (not shown) is connected to the battery terminal 107. Connected to the terminal parts 106*a* and 111*a* in the connector housing portions 115 are the terminals of the counter connectors 118. LA terminals 119 are connected to the terminal parts 106*b* and 111*b* of the terminal supports 116 by means of screws. The connectors of the counter connector 118 and the LA terminals 119 are connected to loads by way of cables 120. Power source is distributed from a battery to those loads, through a fuse circuit. When shortcircuiting occurs in any of the loads and overcurrent flows into the related fusible member 105 (110), the fuse member burns out by heating to thereby prevent trouble by overcurrent.

In the fusible link unit 100 thus constructed, the first and second fuse circuit structures 101 and 102, shaped like flat plates, are assembled into the housing 103 to thereby form a unit. Therefore, a fuse circuit containing a number of fusible members (fuses) 105 and 110 may be made considerably compact. In particular, as shown in FIG. 14, the first and second fuse circuit structures 101 and 102 may be disposed in a state that those structures are merely spaced a narrow distance W apart from each other. Accordingly, to the fuse circuit extension, what a designer has to do is to slightly increase the housing 103 in the width direction Y, not in the longitudinal direction L.

In the conventional fusible link unit, the first and second fuse circuit structures 101 and 102 are each formed with one flat plate member. Accordingly, current flows always through the linking plates 104 and 109 even if it is fed from any of the terminal parts 106*a*, 111*a*, 106*b*, and 111*b*. Accordingly, a problem arises that temperature of the linking plates 104 and 109 rises by the current flowing therethrough.

To lessen the temperature rise, all one has to do is to increase the areas of the linking plates 104 and 109. However, to make the housing 103 compact, it is desirable to minimize the external dimensions of the first and second fuse circuit structures 101 and 102. Accordingly, it is preferable to avoid increasing the external dimensions of the first and second fuse circuit structures 101 and 102.

SUMMARY OF THE INVENTION

Accordingly, an object of the present invention is to provide a fusible link unit which can reliably suppress the temperature rise of the fuse circuit structures with little increasing of the external dimensions of the fuse circuit structures.

According to the present invention, there is provided a fusible link unit comprising:

a fuse circuit structure including a plurality of terminal parts linked through fusible members to a linking plate, and a housing into which the fuse circuit structure is assembled, wherein the fuse circuit structure is formed by laminating a plurality of part plates, a first part plate includes a first linking portion constituting the linking plate by being laminted by a second linking portion of a second part plate, and a respective part of the plurality of terminal parts which are connected to the linking plate with a respecitve part of the fusible members are provided with the first part plate.

In the fusible link unit thus constructed, current flowing through the linking plate of the fuse circuit structure branches into plural current paths to thereby suppress heat generation by the current flow.

In a preferred embodiment of the invention, the terminal parts with the fusible members connected thereto and the terminal parts, which are shared by the part plates, are substantially equal in number.

In the embodiment having the advantage mentioned above, current branches into the linking portions of the part plates at almost equal ratios.

In another embodiment, two part plates are used.

The fusible link unit of the embodiment has advantages comparable with those mentioned above.

DETAILED DESCRIPTION OF THE PREFERRED EMBODIMENTS

The preferred embodiment of the present invention will be described with reference to the accompanying drawings.

Figure 1:
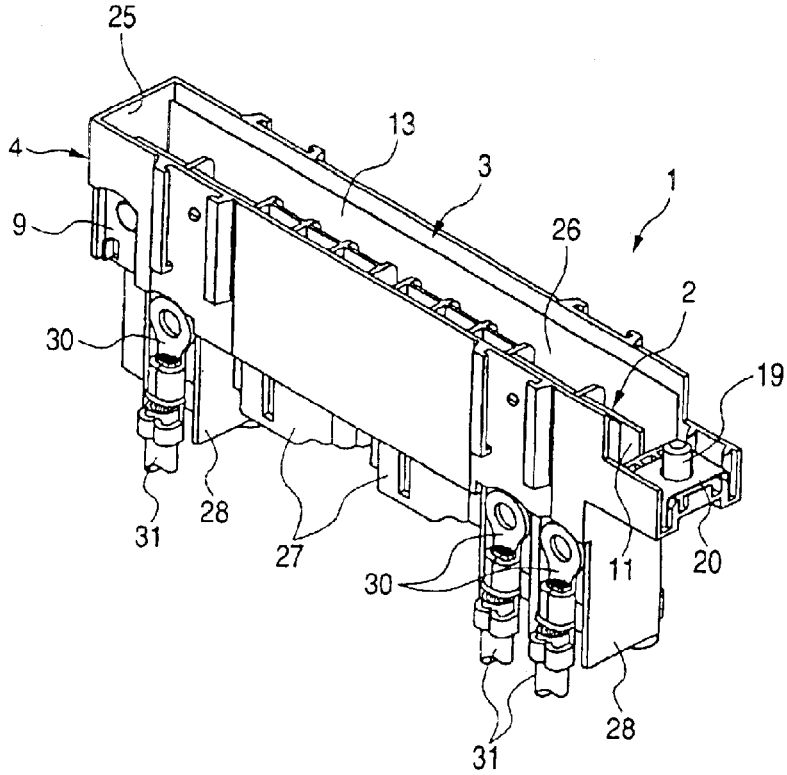
FIG. 1 is a perspective view showing a fusible link unit, which is an embodiment of the invention.
Figure 2:
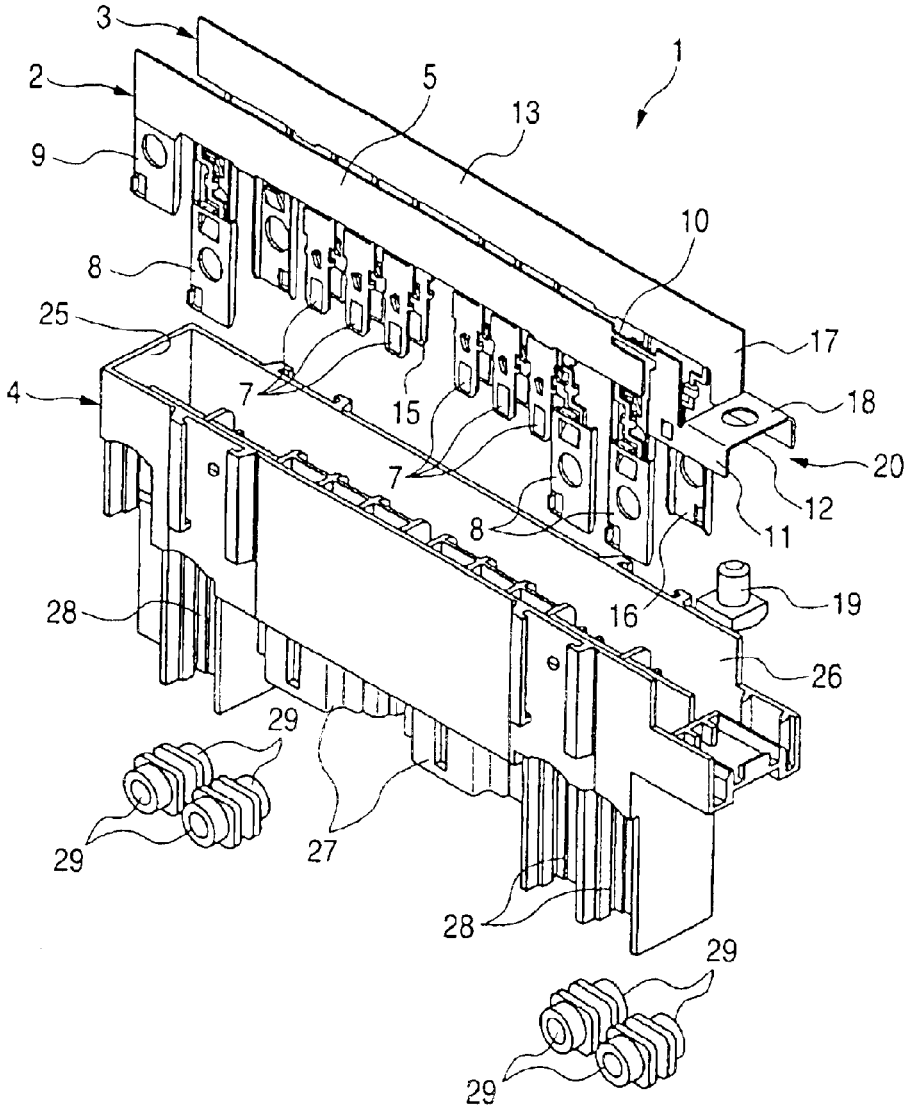
FIG. 2 is an exploded, perspective view showing the fusible link unit.
Figure 3:
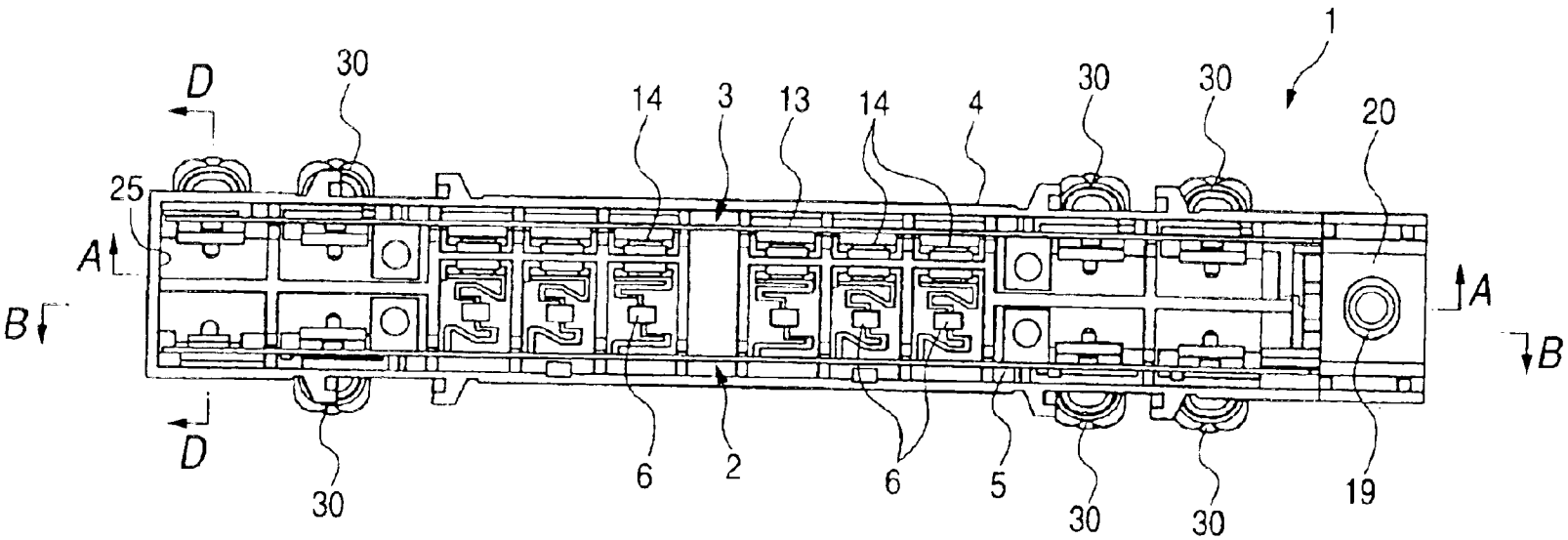
FIG. 3 is a plan view showing the fusible link unit.
Figure 4:
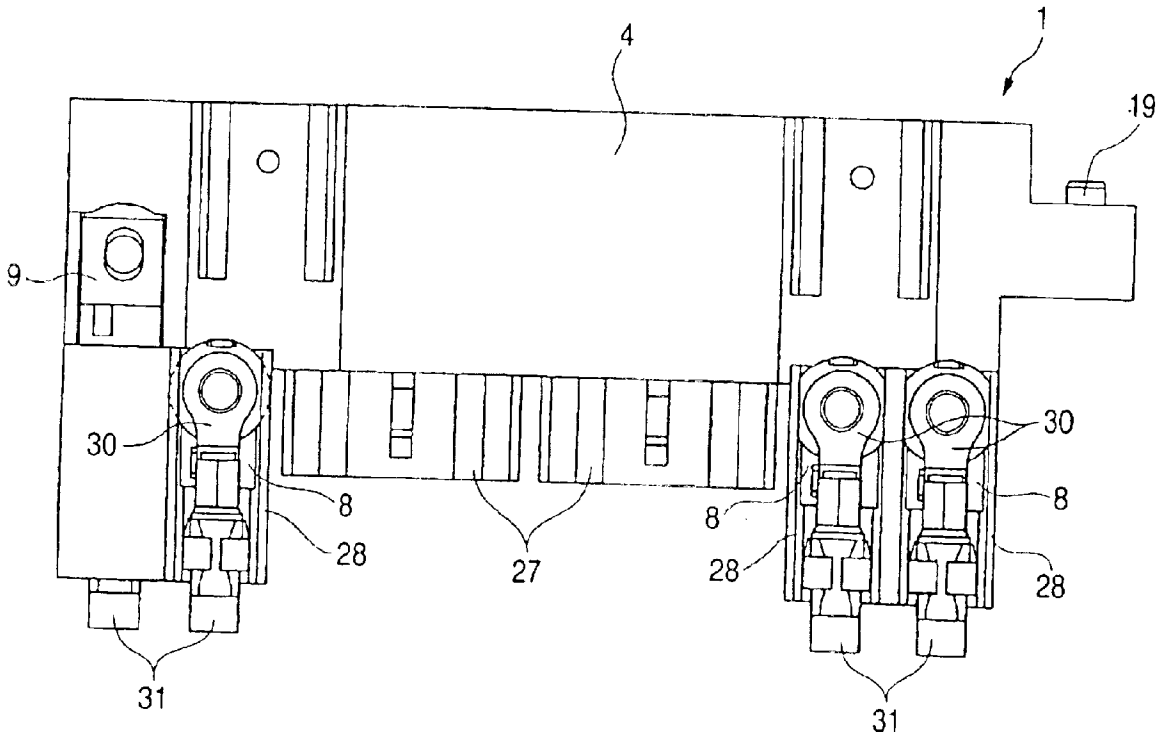
FIG. 4 is a front view showing the fusible link unit.
Figure 5:
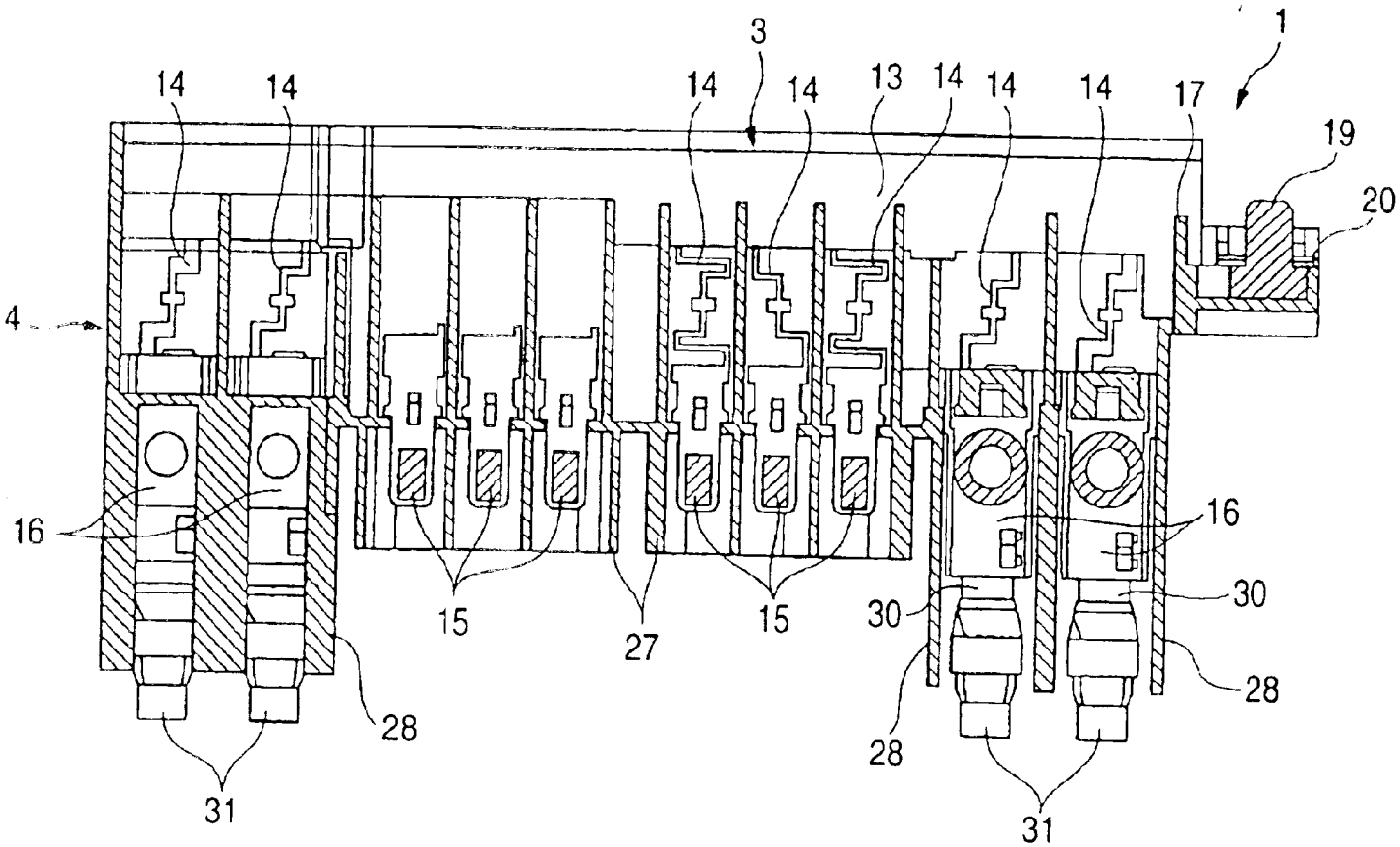
FIG. 5 is a cross sectional view taken on line A—A in FIG. 3.
Figure 6:
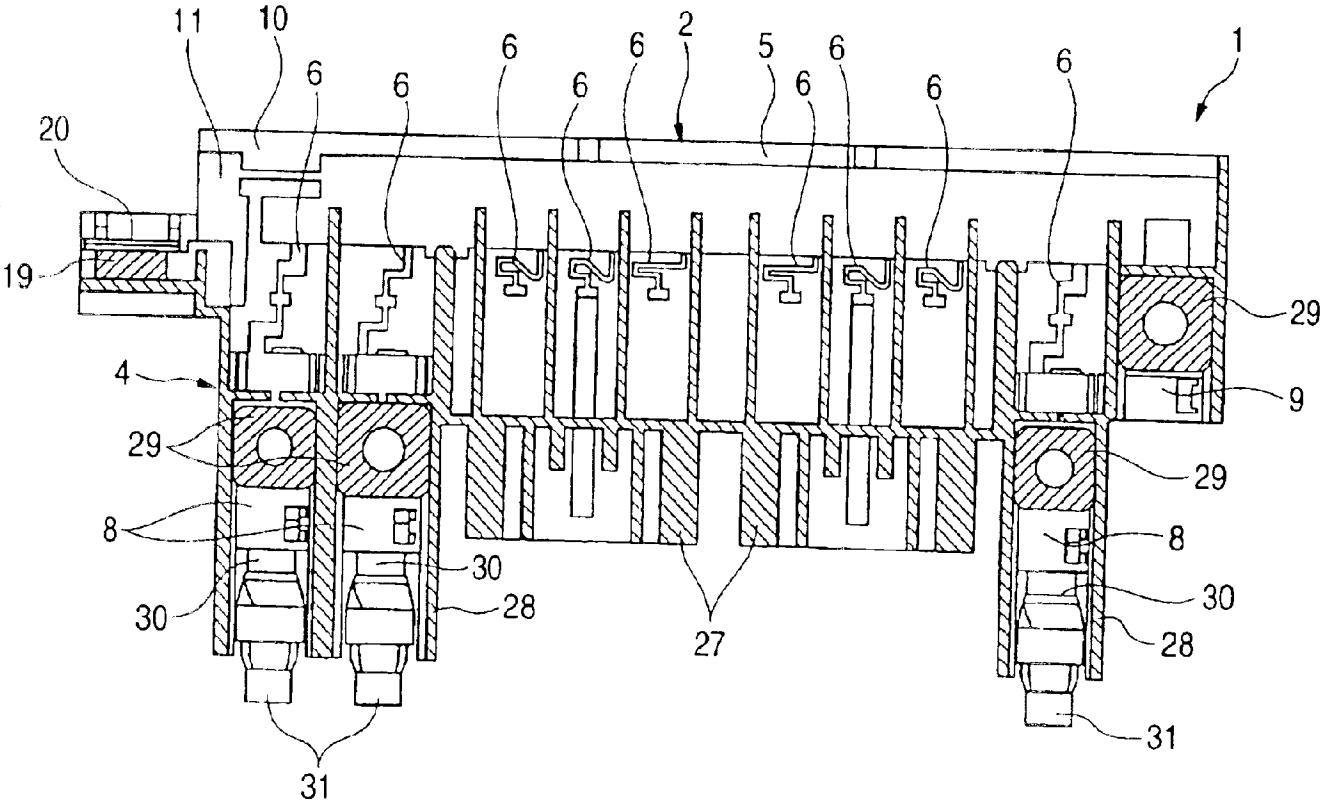
FIG. 6 is a cross sectional view taken on line B—B in FIG. 3.
Figure 7:
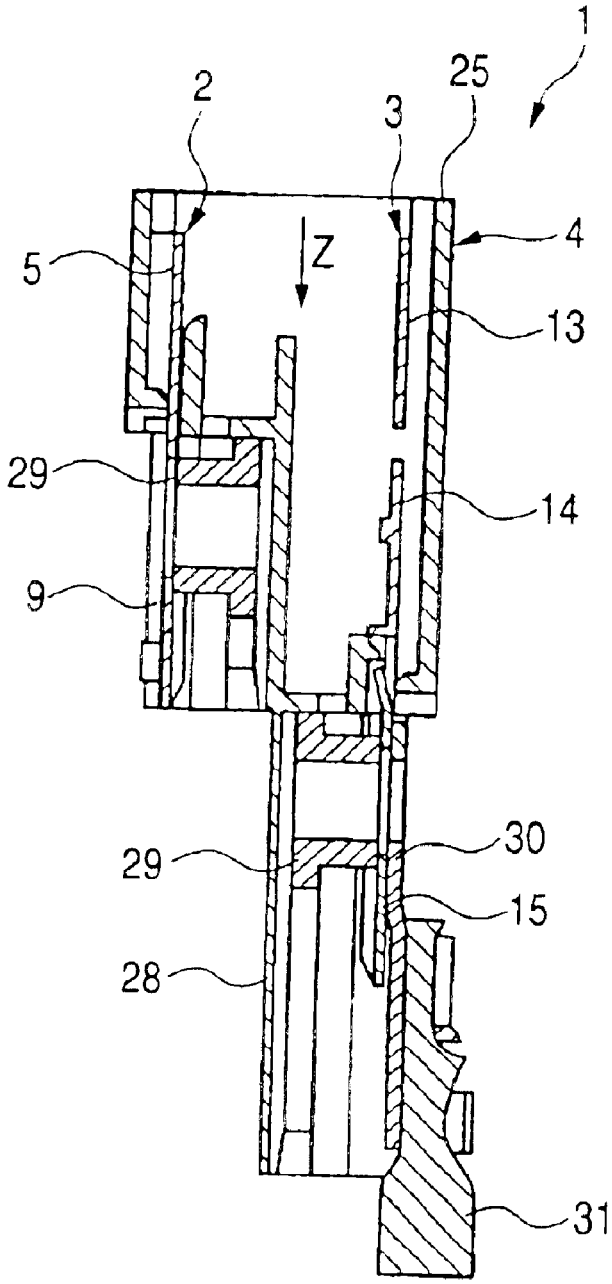
FIG. 7 is a cross sectional view taken on line D—D in FIG. 3.
Figure 8:
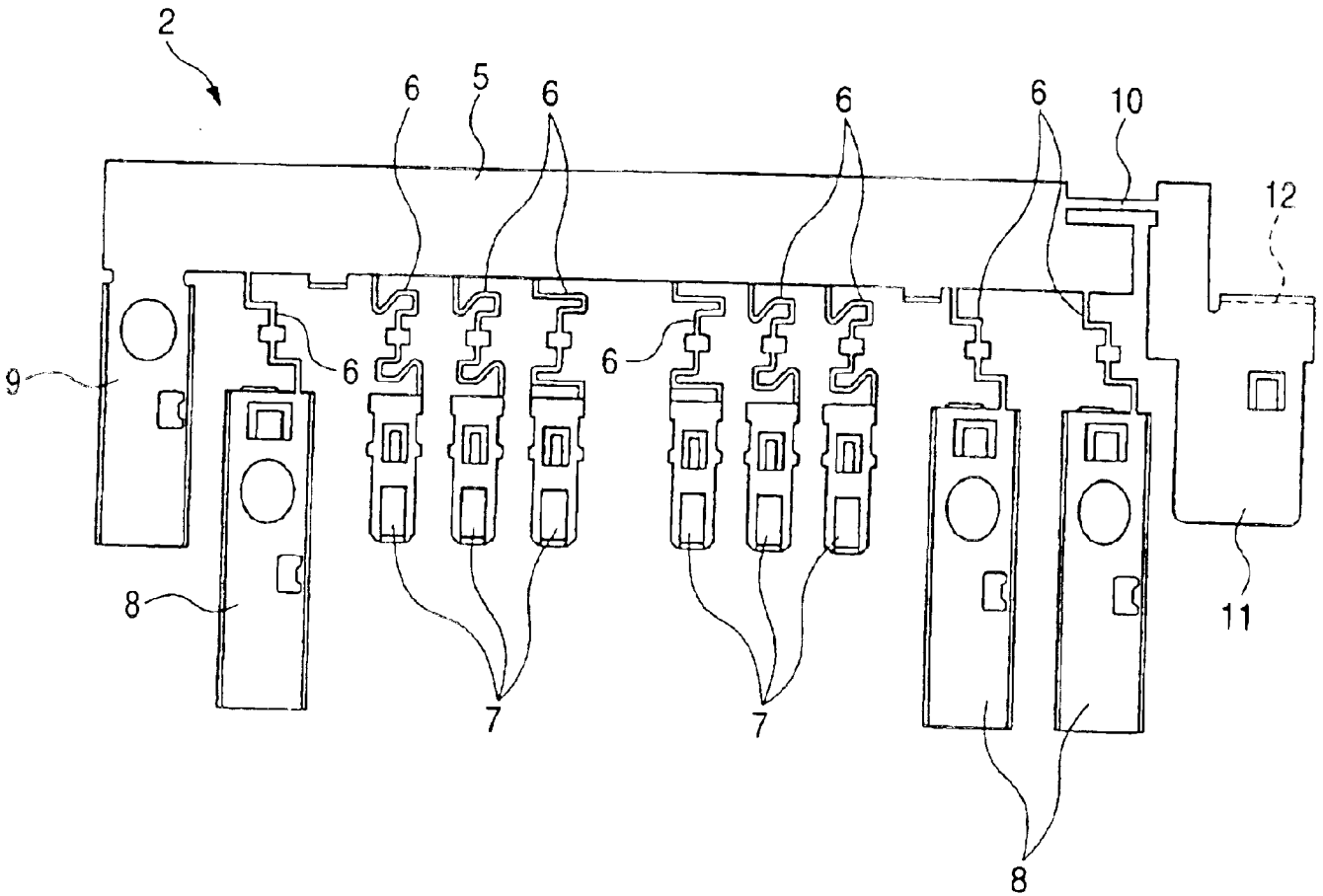
FIG. 8 is a front view showing a first fuse circuit structure of the fusible link unit.
Figure 9:
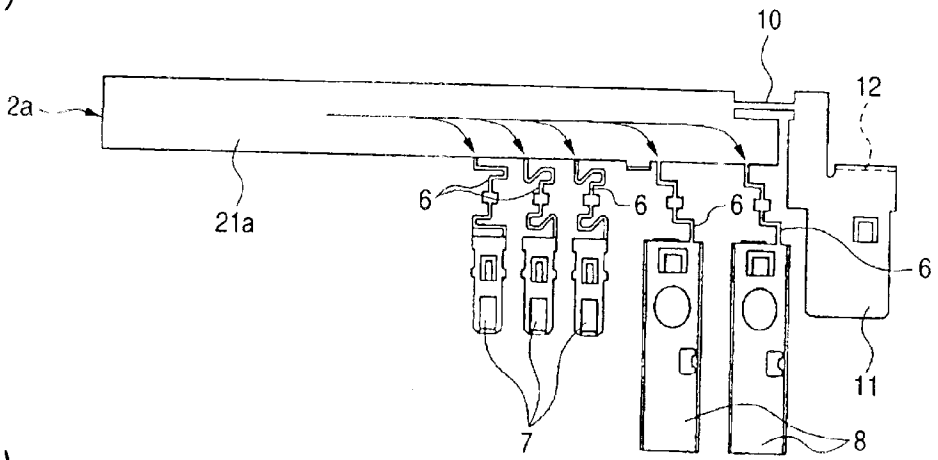
FIGS. 9(*a*) and 9(*b*) are front views showing part plates forming the first fuse circuit structure of the fusible link unit.
Figure 9:
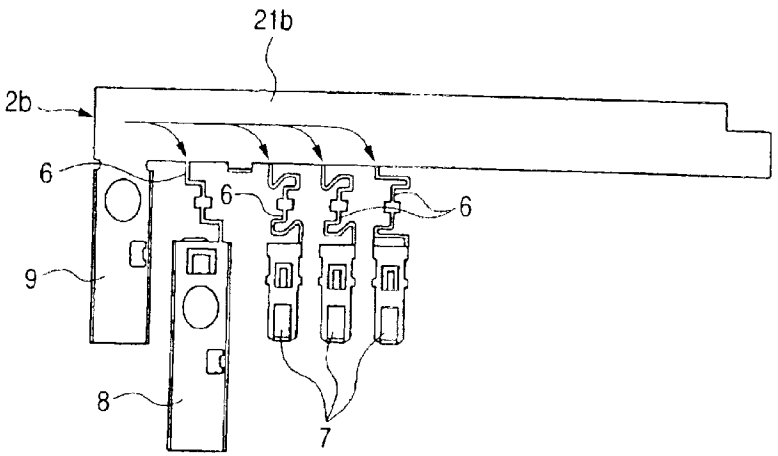
Figure 10:
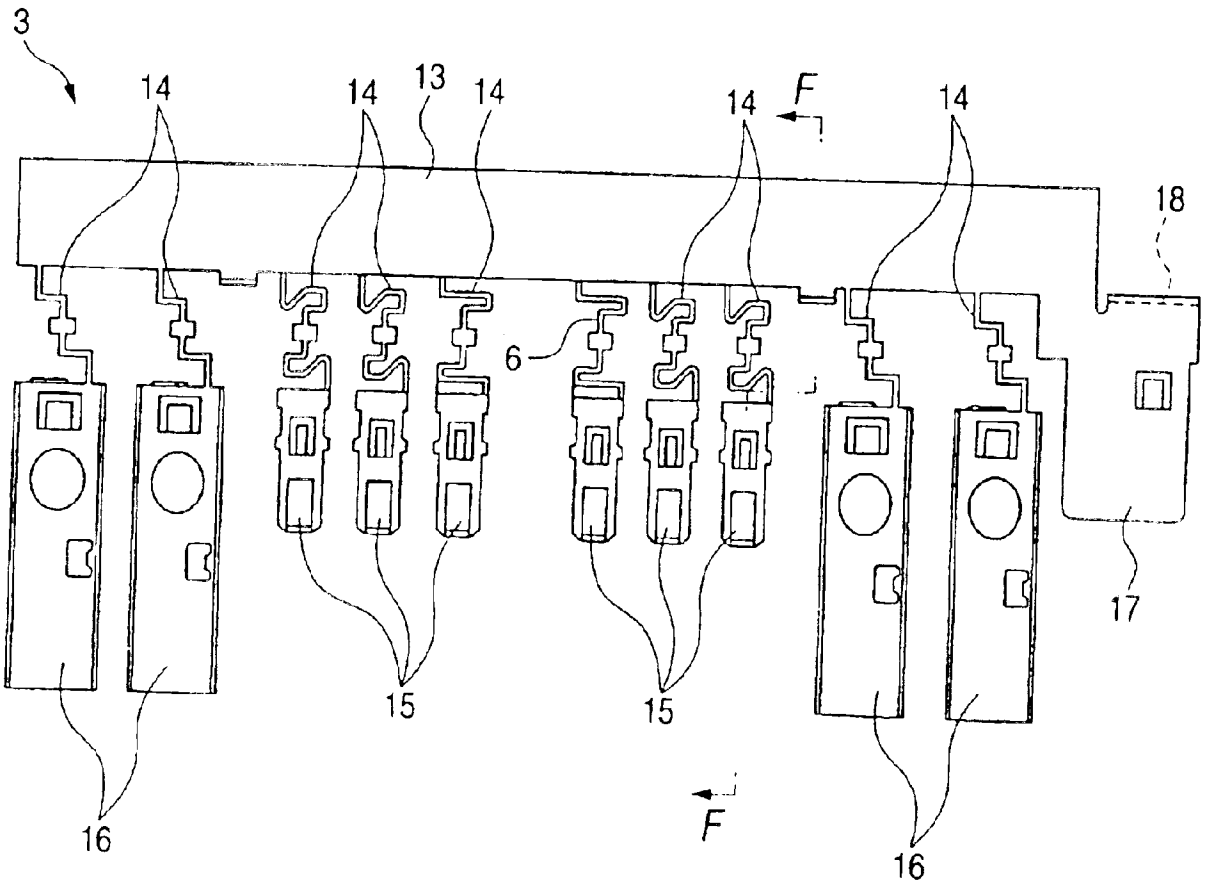
FIG. 10 is a front view showing a second fuse circuit structure of the fusible link unit.
Figure 11:
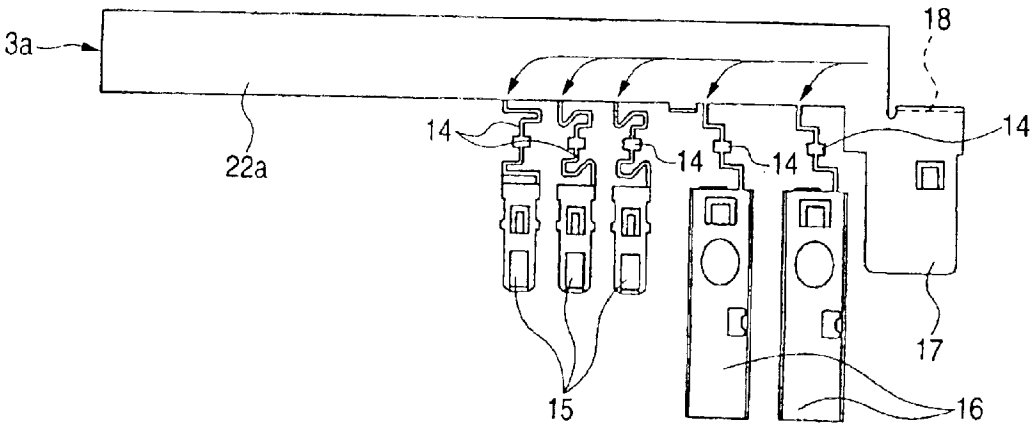
FIGS. 11(*a*) and 11(*b*) are front views showing part plates forming the second fuse circuit structure of the fusible link unit.
Figure 11:
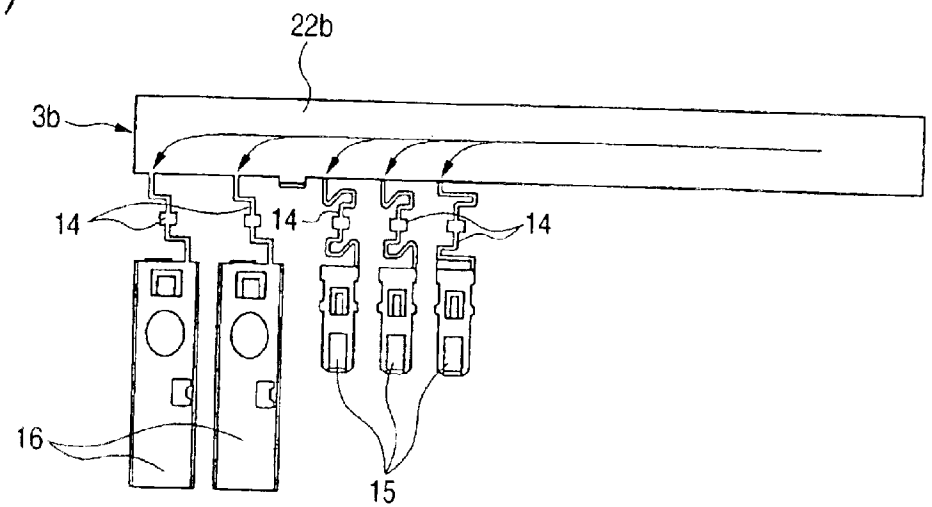
Figure 12:
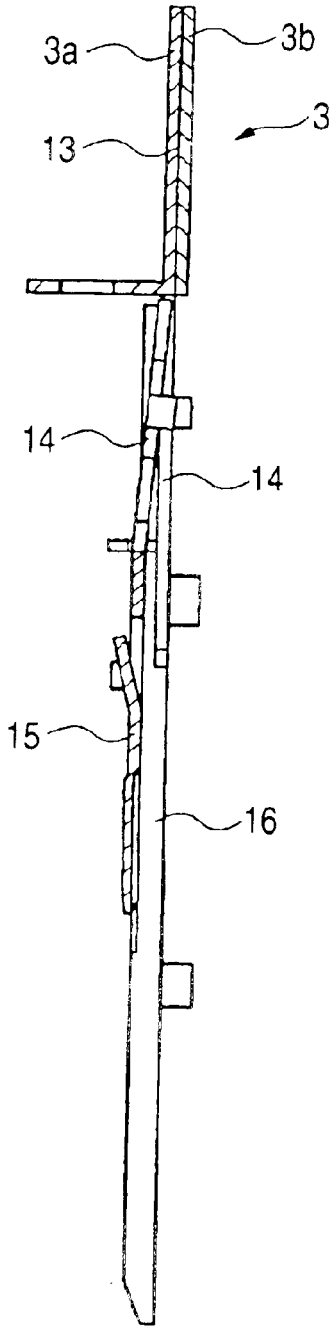
FIG. 12 is a cross sectional view taken on line F—F in FIG. 10.
Figure 13:
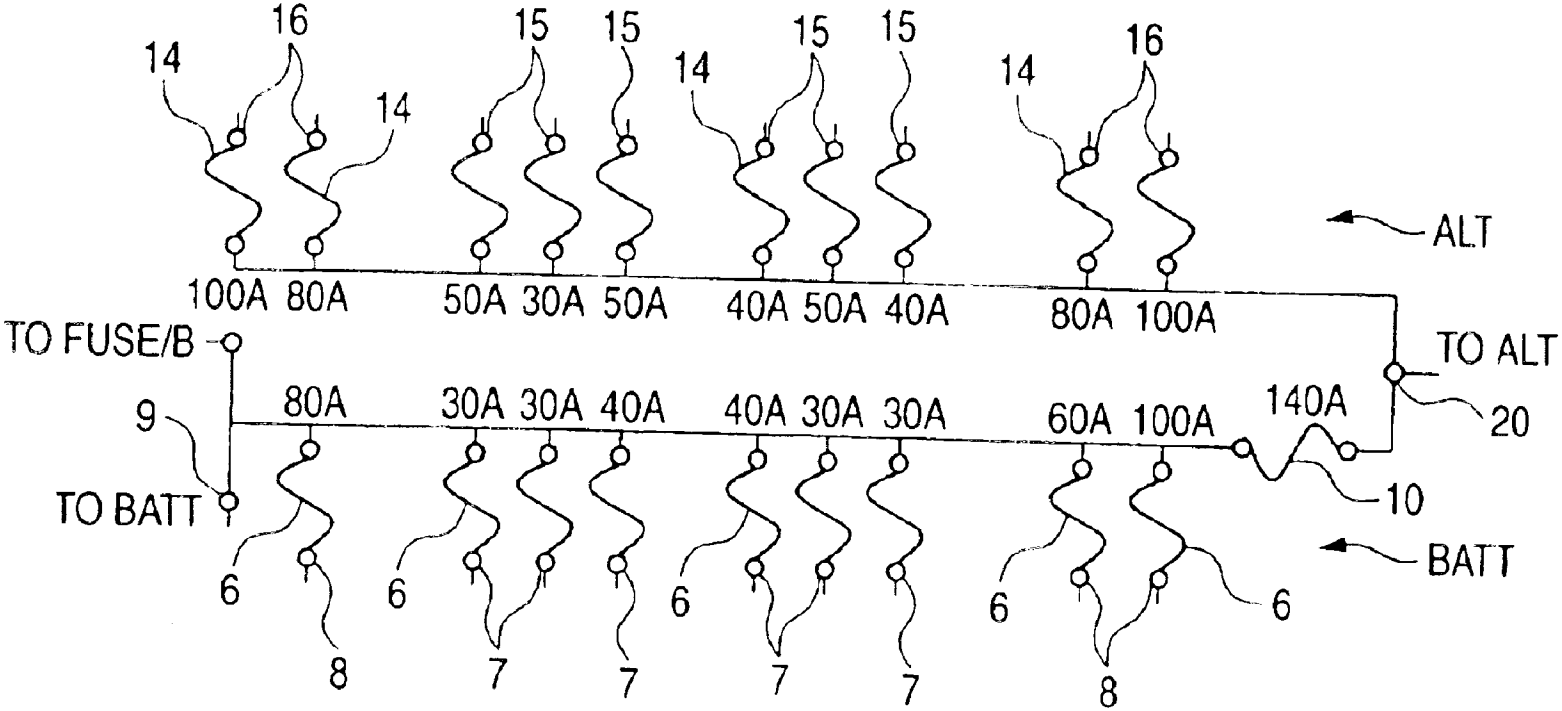
FIG. 13 is a circuit diagram showing a fuse circuit formed by the first and second fuse circuit structures.
Figure 14:
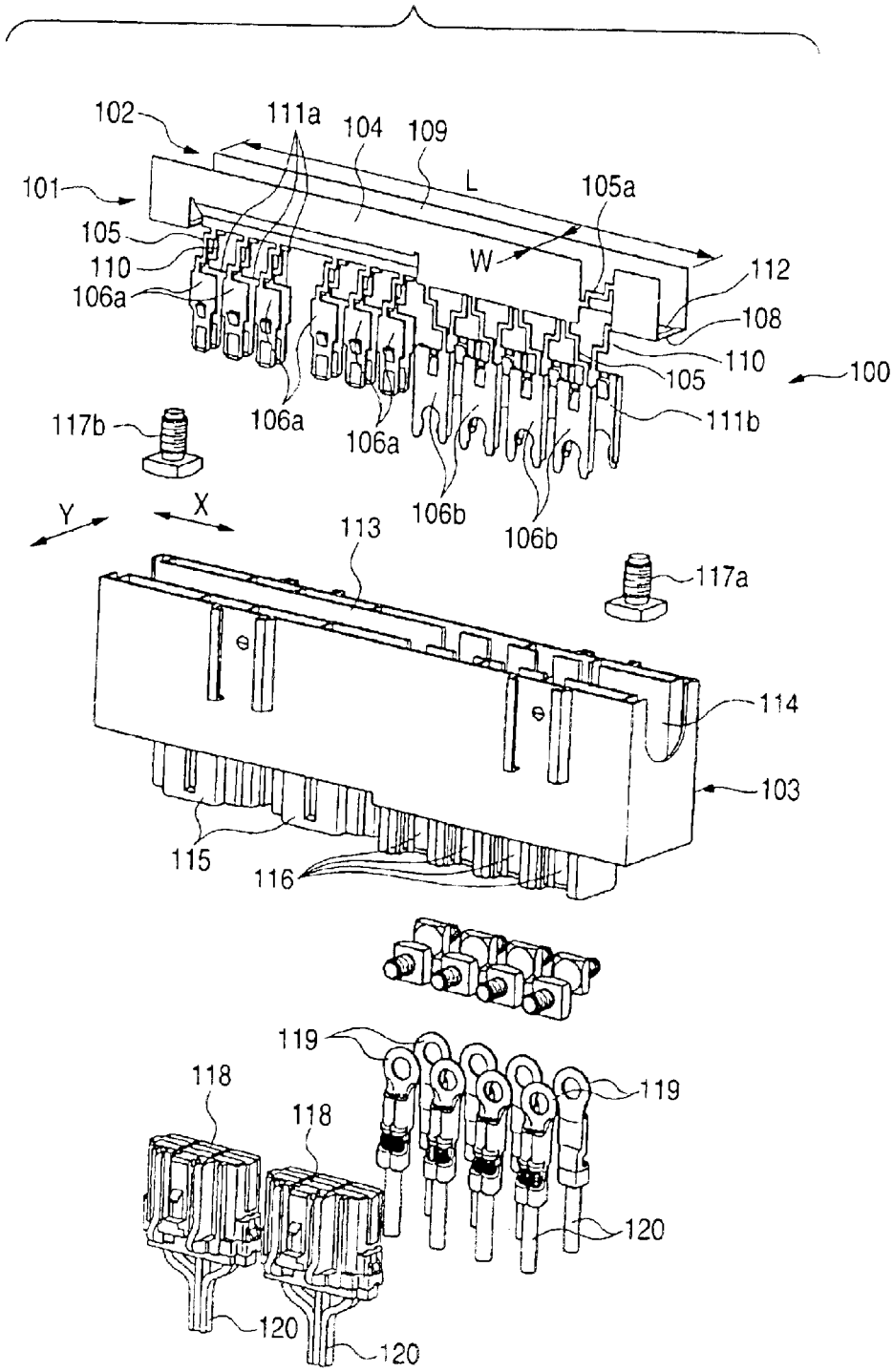
FIG. 14 is an exploded, perspective view showing a conventional fusible link unit.
Figure 15:
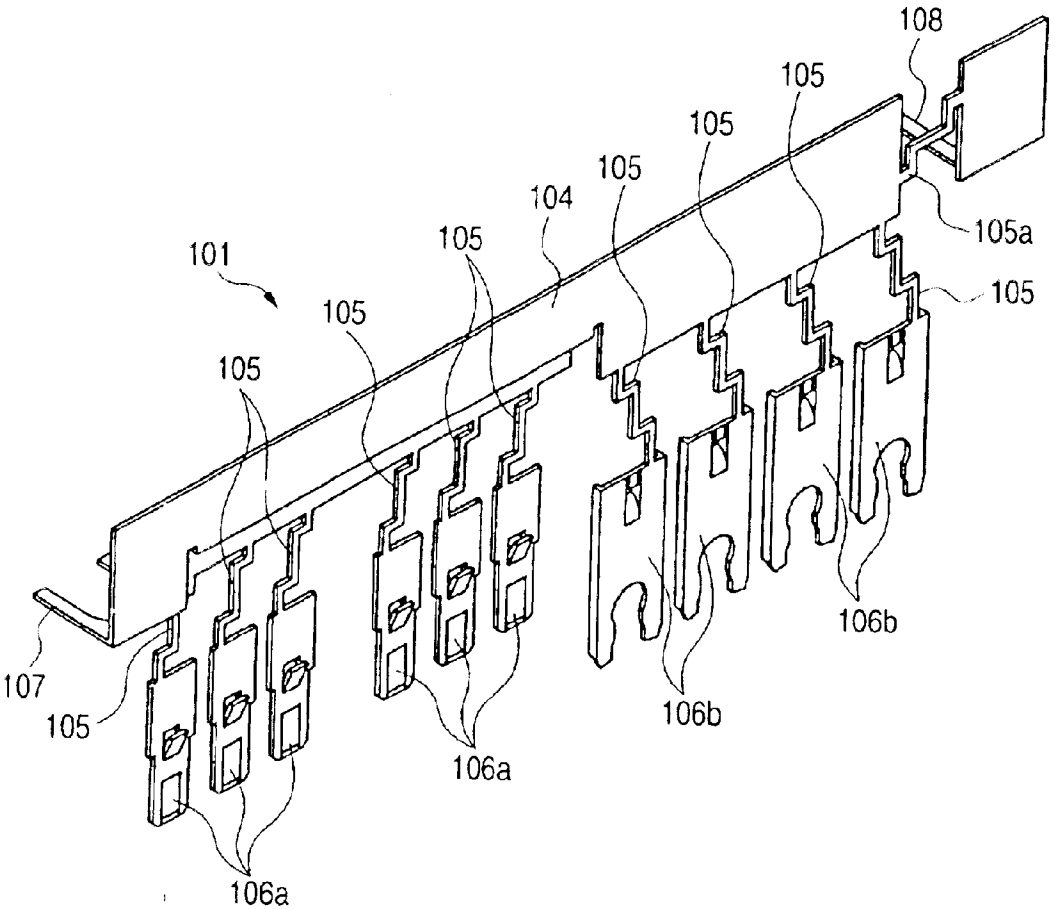
FIG. 15 is a front view showing a first fuse circuit structure of the conventional fusible link unit.
Figure 16:
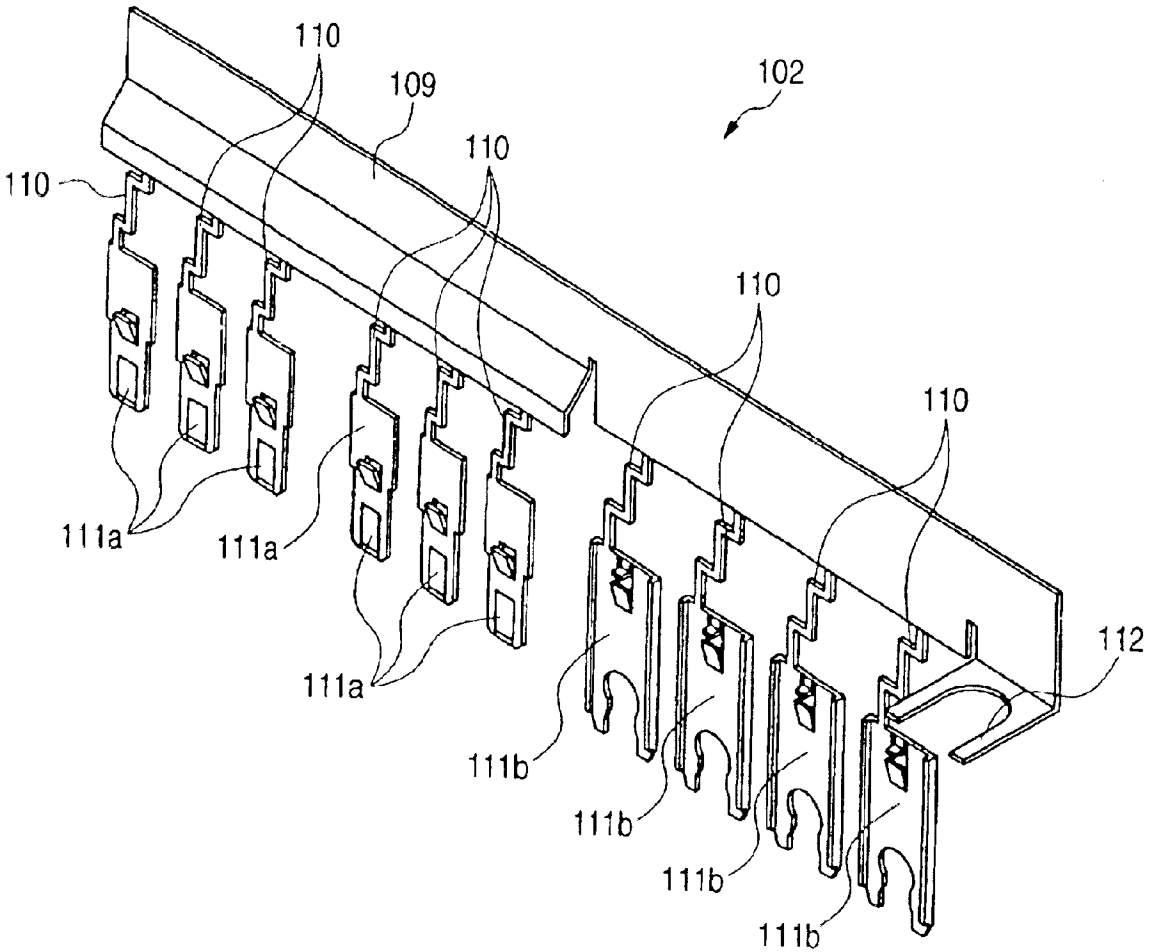
FIG. 16 is a front view showing a second fuse circuit structure of the conventional fusible link unit.

FIGS. 1 through 14 show the embodiment of the invention. Of those figures, FIG. 1 is a perspective view showing a chained type large current fusible link unit. FIG. 2 is an exploded, perspective view showing the fusible link unit. FIG. 3 is a plan view showing the fusible link unit. FIG. 4 is a front view showing the fusible link unit. FIG. 5 is a cross sectional view taken on line A—A in FIG. 3. FIG. 6 is a cross sectional view taken on line B—B in FIG. 3. FIG. 7 is a cross sectional view taken on line D—D in FIG. 3. FIG. 8 is a front view showing a first fuse circuit structure of the fusible link unit. FIGS. 9(*a*) and 9(*b*) are front views showing part plates forming the first fuse circuit structure of the fusible link unit. FIG. 10 is a front view showing a second fuse circuit structure of the fusible link unit. FIGS. 11(*a*) and 11(*b*) are front views showing part plates forming the second fuse circuit structure of the fusible link unit. FIG. 12 is a cross sectional view taken on line F—F in FIG. 10. FIG. 13 is a circuit diagram showing a fuse circuit formed by the first and second fuse circuit structures.

As shown in FIGS. 1 through 8, a fusible link unit 1 is generally made up of a first fuse circuit structure 2 as a bus bar, a second fuse circuit structure 3 also as a bus bar, and a housing 4 which is made of synthetic resin, and into which the first and second fuse circuit structures 2 and 3 are assembled and disposed while being spaced from each other by a predetermined distance.

The first fuse circuit structure 2, as shown in detail in FIG. 8, is made up of a narrow, cuboid linking plate 5, a plurality of female terminal parts 7 chain-coupled through fusible members 6 to the linking plate 5 in a short side direction of the linking plate 5, a plurality of screw fixing terminal parts 8 chain-coupled through fusible members 6 to the linking plate 5 in a width side direction of the linking plate 5, a battery terminal (screw fixing terminal part) 9 coupled to the linking plate 5 directly or not through the fusible member in the width direction of the linking plate 5, and an insert lock part 11 coupled to the linking plate 5 through a fusible member 10 in the longitudinal direction of the linking plate 5. The first fuse circuit structure 101 is formed by pressing a conductive plane plate (not shown).

Each fusible member 6 is narrow and shaped like a crank, and a low melting point metal is fastened to a mid part of the crank-shaped fusible member by caulking. When current of a predetermined value or larger flows into the fusible member, the fusible member burns out. The fusible member 10 is long, and straight in shape or takes a shape of S or V. The fusible members 6 which are located between the linking plate 5 and the screw fixing terminal parts 8 are arranged on a plane, not inclined with respect to the palne direction of the linking plate 5.

A plurality of female terminal parts 7 are grouped and the female terminal parts of each group are arranged side by side in a chained manner. A plurality of screw fixing terminal parts 8 are also grouped and arranged in a similar manner. A part of the insert lock part 11 is bent in the vertical direction to form a common terminal part 12.

The second fuse circuit structure 3, as shown in FIG. 10, is made up of a narrow, rectangular linking plate 13, a plurality of female terminal parts 15 chain-coupled through fusible members 14 to the linking plate 13 in a width direction of the linking plate 13, a plurality of screw fixing terminal parts 16 chain-coupled through fusible members 14 to the linking plate 13 in a width direction of the linking plate 13, and an insert lock part 17 extending in a longitudinal direction of the linking plate 13. The second fuse circuit structure 3 is formed by pressing a conductive plane plate (not shown).

Each fusible member 14, like fusible member 6 of the first fuse circuit structure 2, is narrow and shaped like a crank, and a low melting point metal is fastened to a mid part of the crank-shaped fusible member by caulking. When current of a predetermined value or larger flows into the fusible member, the fusible member burns out. As shown in FIGS. 7 and 12, the fusible members 14 which are located between the linking plate 13 and the screw fixing terminal parts 16, like those of the first fuse circuit structure 2, are arranged on a plane, not inclined with respect to the plane direction Z of the linking plate 5, A plurality of female terminal parts 15, like those of the first fuse circuit structure 2, are grouped and the female terminal parts of each group are arranged side by side in a chained manner. A plurality of screw fixing terminal parts 16 are also grouped and arranged in a similar manner. A part of the insert lock part 17 is bent in the vertical direction to form a common terminal part 18, as in the case of the first fuse circuit structure 2. The common terminal parts 12 and 18 of the first and second fuse circuit structures 2 and 3, when mounted on the housing 4, are made coherent to each other, together with a bolt 19. Both the common terminal parts 12 and 18 form an alternator terminal.

The first fuse circuit structure 2 is formed by joining together a first part plate 2*a* (FIG. 9(*a*)) and a second part plate 2*b* (FIG. 9(*b*). The second fuse circuit structure 3 is likewise formed by joining together a first part plate 3*a* (FIG. 11(*a*)) and a second part plate 3*b* (FIG. 11(*b*). The first part plate 2*a* (3*a*) is formed with a linking portion 21*a* (22*a*) forming the linking plate 5, the fusible members 6, 10 (14), and the terminal parts 7, 8 (15, 16) and the like, which are located in the right area of the linking plate 5. The second part plate 2*b* (3*b*) is formed with a linking portion 21*b* (22*b*) forming the linking plate 13, the fusible members 6, (14), and the terminal parts 7, 8 (15, 16) and the like, which are located in the left area of the linking plate 13. Specifically, the linking plate 5 (13) of the first fuse circuit structure 2 (3) is formed by laminating the two part plates 2*a* and 2*b* (3*a*, 3*b*). The remaining parts are each formed with a single part plate, which is one of those part plates 2*a*, 3*b*, 3*a* and 3*b*.

As shown in FIGS. 1 to 8, the housing 4 is shaped like a rectangular parallelepiped, and contains a circuit-structure accommodating chamber 26 with an opening 25 open to the upper. The housing further includes a plurality of connector housing portions 27 and a plurality of terminal supports 28, which are located under the circuit-structure accommodating chamber 26. A transparent cover is attached to the top of the housing 4 to thereby close the opening 25.

Next, an assembling process of the fusible link unit 1 will be briefly described below. As shown in FIG. 2, the first and second fuse circuit structures 2 and 3 are each inserted into the circuit-structure accommodating chamber 26, through the opening 25 of the housing 4. In this case, an extending direction Z of the flat surface of each of the first and second fuse circuit structures 2 and 3 is an insertion direction, and the female terminal parts 7, 15 and the like of the fuse circuit structure are first inserted as an insertion tip part.

When the first and second fuse circuit structures 2 and 3 are completely inserted into the circuit-structure accommodating chamber 26 through the opening 25 of the housing 4, while being spaced a predetermined distance apart from each other, the linking plates 5 and 13 of those fuse circuit structures 2 and 3 are located within the circuit-structure accommodating chamber 26, as shown in FIGS. 5 to 8. The terminal parts 6, 7, 15 and 16 are set at predetermined positions in the connector housing portions 27 and of the terminal supports 28.

The common terminal parts 12 and 18 of the first and second fuse circuit structures 2 and 3, together with a bolt 19, are made coherent to one another. Both the common terminal parts 12 and 18 form an alternator terminal. The first and second fuse circuit structures 2 and 3 are electrically connected through the common terminal parts 12 and 18, whereby a fuse circuit shown in FIG. 13 is formed.

Next, the terminal (not shown) for the battery cable is connected to the battery terminal 9, and LA terminals (none of them are shown) for the alternator cable are connected to the alternator terminal 20 by means of the bolt 19 and a nut. Connected to the female terminal parts 7 and 15 in the connector housing portions 27 are male terminals (not shown) of the counter connector. The LA (circular) terminals 30 are connected to the screw fixing terminal parts 8 and 16 of the terminal supports 28 by means of nut members 29 and screws. The male terminals and the LA terminals 30 of the counter connector are connected to related loads by way of a cable 31.

Power source that is supplied from a battery or an alternator is distributed to the loads by way of the fuse circuit of the fusible link unit 1. When the output electric power of the battery decreases to a predetermined level of electric power, the alternator supplies electric power source to the battery to thereby charge the battery.

When shortcircuiting, for example, occurs in any of the loads and overcurrent flows into the related fusible member 6 (10, 14), which in turn burns out by heating, to thereby prevent the trouble by overcurrent. In the maintenance and inspection of the fusible link unit 1, the service man looks into the housing 4 through the opening 25 to check the status of the fusible members 6, 10, 14 (if a fusible member or members having burnt out are present).

In distributing electric power to the loads through the first and second fuse circuit structures 2 and 3, current flowing through the linking plates 5 and 13 of the first and second fuse circuit structures 2 and 3 flows through the linking portions 21*a*, 22*a*, 21*b*, 22*b* of the different part plates 2*a*, 3*a*, 2*b*, 3*b* by the female terminal parts 7 and 15, and the screw fixing terminal parts 8 and 16, as shown in FIGS. 9(*a*), 9(*b*), 11(*a*), and 11(*b*). Accordingly, the current flowing through the linking plates 5 and 13 of the first and second fuse circuit structures 2 and 3 branches off into plural current flows, thereby lessening heat generation. Accordingly, the fusible link unit which can reliably suppress the temperature rise of the fuse circuit structures with little increasing of the external dimensions of the first and second fuse circuit structures 2 and 3.

The female terminal parts 7 (15) with the fusible members 6 (14) connected thereto and the screw fixing terminal parts 8 (16), which are shared by the part plates 2*a*, 3*a*, 2*b* and 3*b*, are substantially equal in number. Accordingly, current branches into the linking portions 21*a*, 22*a*, 21*b*, 22*b* of the part plates 2*a*, 3*a*, 2*b*, 3*b* at almost equal ratios. As a result, the part plates 2*a*, 3*a*, 2*b* and 3*b* effectively suppress the temperature rise.

In the embodiment, the first and second fuse circuit structures 2 and 3 are each formed by laminating two part plates 2*a*, 3*a*, 2*b*, 3*b*. If required, three or more part plates may be laminated for the formation of the fuse circuit structure.

In the embodiment mentioned above, the fuse circuit is constructed with two fuse circuit structures, i.e., the first and second fuse circuit structures 2 and 3. It is readily understood that the invention may be applied to a fusible link unit where the fuse circuit is constructed with a single fuse circuit structure or three or more fuse circuit structures.

As seen from the foregoing description, in the invention, a plurality of part plates include linking portions corresponding to the linking plates and the terminal parts with the fusible members connected thereto, which are shared by the part plates. Current flowing through the linking plate of the fuse circuit structure branches into plural current paths to thereby suppress heat generation by the current flow. Accordingly, the fusible link unit can reliably suppress the temperature rise of the fuse circuit structures with little increasing of the external dimensions of the fuse circuit structures.

In a preferred embodiment, current branches into the linking portions of the part plates at almost equal ratios. Therefore, the embodiment effectively suppresses the temperature rise.

Another embodiment of the invention uses two part plates, and hence has advantages comparable with those mentioned above.

What is claimed is:

1. A fusible link unit comprising:

a fuse circuit structure including a plurality of terminal parts linked through fusible members to a linking plate, and a housing into which the fuse circuit structure is assembled, wherein the fuse circuit structure is formed by laminating a plurality of part plates, a first part plate includes a first linking portion constituting the linking plate by being laminated by a second linking portion of a second part plate, and a respective part of the plurality of terminal parts which are connected to the linking plate with a respective part of the fusible members are provided with the first part plate.

2. A fusible link unit according to claim 1, wherein the first part plate and the second part plate have substantially identical number of the terminal parts to each other.

3. A fusible link unit according to claim 1, wherein the number of the part plates is two.

* * * * *